US008009840B2

(12) United States Patent
Kellermann et al.

(10) Patent No.: US 8,009,840 B2
(45) Date of Patent: Aug. 30, 2011

(54) MICROPHONE CALIBRATION WITH AN RGSC BEAMFORMER

(75) Inventors: Walter Kellermann, Eckental (DE); Parijat Ashok Oak, Mumbay (IN)

(73) Assignee: Siemens Audiologische Technik GmbH, Erlangen (DE)

( * ) Notice: Subject to any disclaimer, the term of this patent is extended or adjusted under 35 U.S.C. 154(b) by 1140 days.

(21) Appl. No.: 11/541,414

(22) Filed: Sep. 29, 2006

(65) Prior Publication Data

US 2007/0076900 A1 Apr. 5, 2007

(30) Foreign Application Priority Data

Sep. 30, 2005 (DE) ..... 10 2005 047 047

(51) Int. Cl.
*H04R 3/00* (2006.01)

(52) U.S. Cl. ..... 381/92; 381/94.1; 381/71.1; 381/122

(58) Field of Classification Search ..... 381/94.7, 381/92, 91, 94.1, 94.2, 94.3, 71.1, 122, 98, 381/61, 63; 702/190; 700/94
See application file for complete search history.

(56) References Cited

U.S. PATENT DOCUMENTS 6,449,586 B1 * 9/2002 Hoshuyama ..... 702/190
2005/0047611 A1 * 3/2005 Mao ..... 381/94.7
2006/0147054 A1 * 7/2006 Buck et al. ..... 381/92
2006/0222184 A1 * 10/2006 Buck et al. ..... 381/71.1
2007/0055505 A1 * 3/2007 Doclo et al. ..... 704/226

FOREIGN PATENT DOCUMENTS

EP 1478208 A1 11/2004

OTHER PUBLICATIONS

Wolfgang Herbordt, Combination of Robust Adaptive Beamforming with Acoustic ECho Cancellation for Acoustic Human/Machies Interfaces, Dec. 2003, University of Erlangen-Nuerenberg, pp. 98-105. Provided by applicant.*

Wolfgang Herbordt, "Combination of Robust Adaptive Beamforming with Acoustic Echo Cancellation for Acoustic Human/Machine Interfaces", Dissertation, Dec. 3, 2003, pp. 98-105, Friedrich-Alexander University, Erlangen/Nümberg, Germany.

* cited by examiner

*Primary Examiner* — Devona E Faulk
*Assistant Examiner* — Friedrich Fahnert

(57) ABSTRACT

It is intended to improve and automate the calculation of calibration filters connected downstream from the microphones of an RGSC beamformer. To this end it is proposed that an adaptive calibration filter calculation unit be used, by means of which calibration filters are calculated from the output signals of adaptive blocking filters such that the power of an output signal of a blocking filter subtracted from a reference signal and filtered by means of a calibration filter respectively is minimized. The calibration filters connected downstream from the microphones are then replaced by the calibration filters thus determined.

10 Claims, 3 Drawing Sheets

MICROPHONE CALIBRATION WITH AN RGSC BEAMFORMER

CROSS REFERENCE TO RELATED APPLICATIONS

This application claims priority of German application No. 10 2005 047 047.5 filed Sep. 30, 2005, which is incorporated by reference herein in its entirety.

FIELD OF THE INVENTION

The invention relates to a circuit arrangement and a method for microphone calibration with an RGSC beamformer.

BACKGROUND OF THE INVENTION

An RGSC beamformer is known from Wolfgang Herbordt: "Combination of Robust Adaptive Beamforming with Acoustic Echo Cancellation for Acoustic Human/Machine Interface", Dissertation, Friedrich-Alexander University Erlangen/Nuremberg, submitted 03.12.2003, page 99 ff.

A system and method for picking up audio signals is known from US 2005/0047611 A1, with which a microphone array is used to reduce an interference signal compared to a useful signal. To this end the microphones of the microphone array are connected to a beamformer by way of a filter unit and a summation element. In the case of the mentioned document, the filter unit of the beamformer is also referred to in an unconventional manner as a calibration filter.

In general in the case of a beamformer a number of microphones are connected together to form a microphone system, having a directional characteristic. This causes acoustic input signals in the microphone system to be dampened to varying degrees as a function of their direction of incidence into the microphone system. In the case of a beamformer the signal transmission functions of the microphones used have to be tuned very precisely to each other, in order to be able to achieve the desired directional effect. Deviations in the signal transmission functions due to tolerances or ageing effects significantly impair the function of the beamformer, such that it may no longer be possible to ensure a desired interference noise suppression to an adequate degree with the microphone system used. This applies in particular to beamformers with microphone arrays with a very small aperture, as used for example in hearing device applications, in which differential or superdirective beamformer algorithms are frequently used.

It is known that calibration filters can be connected downstream from the microphones of a beamformer, to compensate for component tolerances in the microphones used. The signal transmission response of the microphones is determined once and filter coefficients of calibration filters, connected downstream from the microphones, are set such that the component tolerances are equalized. However this procedure has the disadvantage that ageing effects cannot be taken into account.

SUMMARY OF THE INVENTION

The object of the present invention is therefore to specify an RGSC beamformer, wherein there is automatic compensation for the component tolerances due to ageing in the microphones used.

This object is achieved by an RGSC beamformer and a method for operating an RGSC beamformer with the features claimed in the claims.

In the context of the invention filter calculation refers to the calculation of the transmission function of the filter in question or the calculation of the corresponding filter coefficients to determine this transmission function.

The invention has the advantage that automatic calibration of the microphones takes place during operation of the beamformer. This allows incorrect time-variant microphone adjustments, for example due to ageing, moisture, dirt, etc. to be equalized, without a complex and separate subsequent calibration being required.

BRIEF DESCRIPTION OF THE DRAWINGS

The invention is described in detail in the following with reference to the drawings, in which.

DETAILED DESCRIPTION OF THE INVENTION

Figure 1:
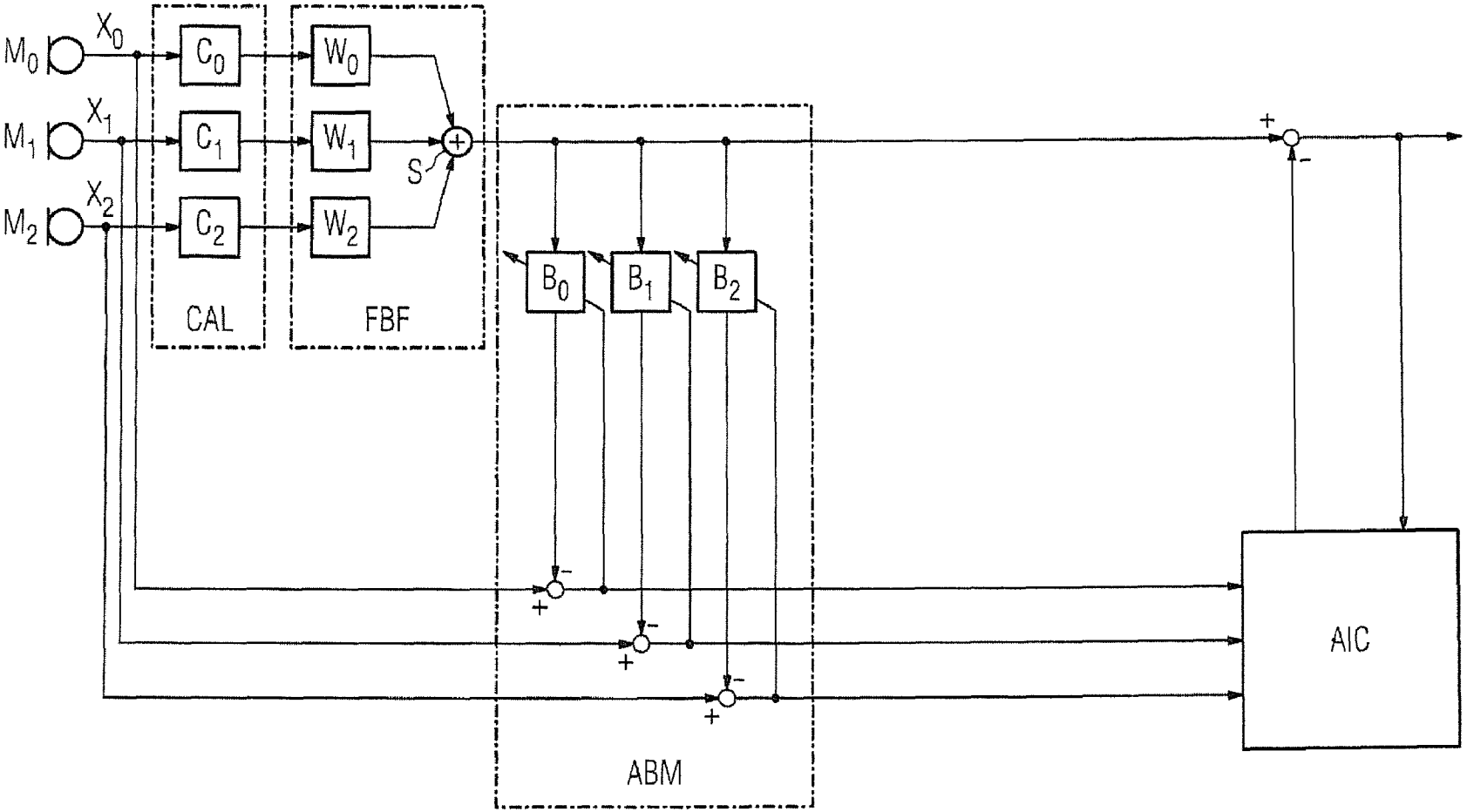
FIG 1 (Prior art)
FIG. 1 shows a RGSC beamgormer know from the prior art.

The RGSC beamformer known from the prior art cited in the introduction and shown in FIG. 1 is described briefly below with reference to an embodiment with three microphones:

At least two microphones are required to set up an RGSC beamformer. However in theory any number of microphones can be used. In the exemplary embodiment the beamformer comprises the three microphones $M_0$, $M_1$ and $M_2$. The calibration filters $C_0$, $C_1$ and $C_2$ are connected downstream from the microphones to equalize component tolerances. Their transmission response is measured to equalize existing component tolerances of the microphones used. The filter coefficients of the calibration filters $C_0$, $C_1$ and $C_2$ are then set such that the microphones combined with the downstream calibration filters show an at least approximately identical signal transmission response. The beamformer filters $W_0$, $W_1$ and $W_2$ are connected downstream from the calibration filters in the signal paths of the microphones. The filtered microphone signals are then added together in the adding unit S to generate a directional characteristic.

It should be noted that, in the case of the illustrated circuit, calibration of the microphones and beamforming can also be carried out, when calibration filters are present only in two microphone signal paths or beamformer filters are present only in two microphone signal paths. The three calibration filters $C_0$, $C_1$ and $C_2$ are referred to together as the calibration filter unit CAL and the beamformer filters $W_0$, $W_1$ and $W_2$ in combination with the adding unit S are referred to together as the fixed beamformer FBF. The microphones $M_0$, $M_1$ and $M_2$ in combination with the calibration filter unit CAL and the fixed beamformer FBF already form a microphone system with a directional characteristic. An acoustic signal arriving from the preferred direction of the directional microphone thus formed (useful signal) is thus elevated compared with an acoustic signal coming from a different direction (interference signal).

A further improvement in the signal to noise ratio results with the known directional microphone system from the use of an adaptive interference canceller AIC. The output of the fixed beamformer FBF here serves as the reference signal for the adaptive interference canceller. An adaptive blocking matrix ABM with blocking filters $B_0$, $B_1$ and $B_2$ blocks the useful signal, such that only the estimate of an interference signal is present at every output of the adaptive blocking matrix ABM respectively. The AIC uses this estimate to suppress the interference in the reference signal (and thus the useful signal).

Figure 2:
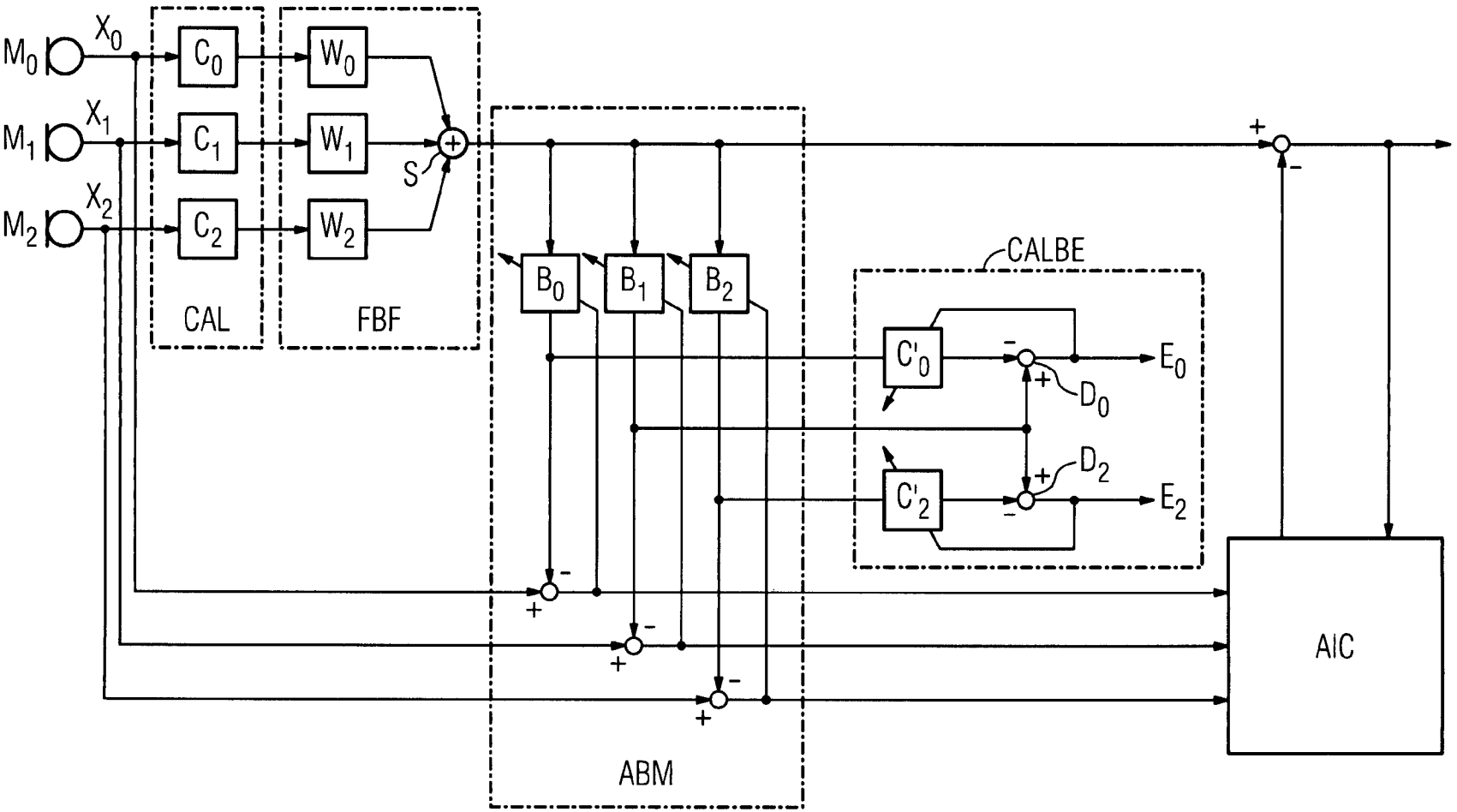
FIG. 2 shows a RGSC beamgormer according to the invention.

The filter coefficients of the calibration filter CAL are set with the circuit known from the prior art by means of a single measurement of the signal transmission response of the microphones used. In order to compensate for ageing phenomena, this measurement should be repeated from time to time. In contrast the invention proposes an automatic, continuous or repeated calibration of the microphones. This is achieved according to the invention in that a calibration filter calculation unit (CALBE) is integrated into the circuit known from the prior art according to FIG. 1. The resulting block circuit diagram is shown for the specific instance of a beamformer with three microphones $M_0$, $M_1$ and $M_2$ in FIG. 2. Here the principle mode of operation of the beamformer corresponds to the mode of operation of the beamformer illustrated in FIG. 1 and described, except that in the case of the beamformer according to the invention automatic calibration of the microphones takes place. To this end the beamformer according to the invention has the calibration filter calculation unit CALBE. The signal outputs of the blocking filters $B_0$, $B_1$ and $B_2$ are fed to this as input variables. One of these output signals of the blocking filters is used as the reference signal. In the exemplary embodiment this is the output signal of the blocking filter $B_1$. In the calibration filter calculation unit CALBE the calibration filters $C_0'$ and/or $C_2'$ are finally determined adaptively such that the energy of the output signals of the blocking filters $B_0$ and/or $B_2$ subtracted from the reference signal and filtered by means of the calibration filters $C_0'$ and/or $C_2'$ is minimized. The calibration filters thus determined are then used as new calibration filters $C_0$ and/or $C_2$ connected downstream from the microphones $M_0$ and/or $M_2$.

To summarize, the calibration algorithm calculates optimized calibration filters in the calibration filter calculation unit CALBE. These are then copied into the calibration filter unit CAL, where they replace the previously valid calibration filters. The input signals for the adaptive algorithm for determining new, improved calibration filters for the calibration filter unit are thus obtained from the filtered output signal of the fixed beamformer FBF. Analysis shows that the filtered output signals of the fixed beamformer are very suitable for determining calibration filters and result in optimized calibration filters (Wiener solution).

A significant advantage of the invention is that the output signal of the fixed beamformer FBF has a better signal-to-noise ratio SNR than the microphone signals. This means that the inputs of the adaptive algorithm are scarcely interfered with by interference noise. This results in fast convergence and good calibration. The signal-to-noise ratio in the output signal of the fixed beamformer FBF also improves with increasing convergence of the calibration filters, such that both the convergence of the blocking filters and the further convergence of the calibration filters are supported. As calibration according to the invention operates automatically, continuously or repeatedly, incorrect time-variant microphone adjustments, for example due to ageing, moisture, dirt, etc, can also be equalized, without complex manual subsequent calibration being required.

The proposed method for calibrating the microphones of an RGSC beamformer can be implemented both in the time range and in the frequency range.

The procedure described in the example of a beamformer with three microphones can also be applied similarly in the context of the invention to beamformers with any number of microphones (≧2).

The theoretical background to microphone calibration according to the invention is set out below:

Analysis

The following analysis is based on a time-discrete Fourier space. It is also assumed that all sensor signals are static and ergodic. The upper-case T and asterisk (*) indicate the transposed or complexly conjugated matrix.

A desired source $S(\omega)$ with a known position sends noise to the microphone array, which comprises M=3 sensors. Let $H_m(\omega)$ be the transition function from the source to the mth microphone. The microphone signals $X^T(\omega)=[X_0(\omega),X_1(\omega),X_2(\omega)]$ can then be written as:

$$X^T(\omega)=S(\omega)H^T(\omega), \tag{1}$$

where $H^T(\omega)=[H_0(\omega),H_1(\omega),H_2(\omega)]$. The microphone signal $X_m(\omega)$ is filtered with the corresponding calibration filter weighting $C_m(\omega)$. The signal $X_1(\omega)$ can be assumed to be the reference signal without restricting generality. $C_1(\omega)=1$ therefore applies. Let $W_m(\omega)$ be the transition function of the FBF (fixed beamformer) for the mth microphone. The FBF output signal $Y_f(\omega)$ is then given by $$Y_f(\omega)=\sum_{m=0}^{2} W_m(\omega)C_m(\omega)X_m(\omega)=S(\omega)\sum_{m=0}^{2} W_m(\omega)C_m(\omega)H_m(\omega). \tag{2}$$

The transition function $B_m(\omega)$ of the mth ABM filter (adaptive blocking matrix, adaptive filter matrix) is determined by minimizing the mean squares of the mth ABM output signal $Y_{b,m}(\omega)$, where $$Y_{b,m}(\omega)=X_m(\omega)-B_m(\omega)Y_f(\omega). \tag{3}$$

With the orthogonality principle it is possible to derive the transition function for the optimum filter as follows:

$$B_m(\omega)=\frac{\Phi_{X_mY_f}(\omega)}{\Phi_{Y_fY_f}(\omega)} \tag{4}$$

where $\Phi_{YfYf}(\omega)$ denotes the spectral power density at the FBF output and $\Phi_{XmYf}(\omega)$ denotes the cross-spectral density between the mth microphone signal and the FBF output. Equations (1) and (2) give the following:

$$B_m(\omega)=\Phi_{SS}(\omega)H_m(\omega)\left(\sum_{m=0}^{2} W_m(\omega)C_m(\omega)H_m(\omega)\right)^*\left(\Phi_{Y_fY_f}(\omega)\right)^{-1}. \tag{5}$$

$\Phi_{SS}(\omega)=S(\omega)S^*(\omega)$ denotes the spectral power density of the desired signal. If $$\psi(\omega)=\Phi_{SS}(\omega)\left(\sum_{m=0}^{2} W_m(\omega)C_m(\omega)H_m(\omega)\right)^*\left(\Phi_{Y_fY_f}(\omega)\right)^{-1}, \tag{6}$$

then the following applies:

$$B_m(\omega)=\Psi(\omega)H_m(\omega). \tag{7}$$

The filtered FBF output signals $\{F_m(\omega);\ m=0, 1, 2\}$ function as input for the adaptive calibration algorithm. Let us consider the calibration path for the microphone m=0. As demonstrated in FIG. 1, this can be written as $$E_0(\omega)=F_1(\omega)-C'_0(\omega)F_0(\omega), \tag{8}$$

The mth filtered FBF output signal $F_m(\omega)$ is then $$F_m(\omega)=B_m(\omega)Y_f(\omega). \tag{9}$$

The optimum calibration filter results from minimizing the mean squares of the error signal $E_0(\omega)$. With the orthogonality principle the transition function for the optimum calibration filter is defined as $$C'_0(\omega)=\frac{\Phi_{F_1F_0}(\omega)}{\Phi_{F_0F_0}(\omega)} \tag{10}$$

Equation (9) shows that $\Phi_{F1F0}=B_1(\omega)B_0^*(\omega)_{YfYf}(\omega)$ and $(\omega_{F0F0}=B_0(\omega)B_0^*(\omega)\Phi_{YfYf}(\omega)$. Therefore $C_0'=B_1(\omega)B_0^{-1}(\omega)$, assuming that $\Phi_{YfYf}(\omega)\neq 0$ and $B_0(\omega)\neq 0$. Equation (7) can be used to calculate the transition function for an optimum calibration as $$C'_0(\omega)=H_1(\omega)H_0^{-1}(\omega). \tag{11}$$

The analysis for the second calibration filter is now carried out in a similar manner:

$$C'_2(\omega)=H_1(\omega)H_2^{-1}(\omega). \tag{12}$$

These are the required transition functions for the optimum calibration filter. The analysis therefore shows that the filtered FBF signals can also be used to obtain calibration filters for microphones instead of microphone signals. However they have an advantage compared with the conventional algorithms applied directly to the microphone signals. In real situations in particular the filtered FBF signals are subject to less interference from interfering noise than the microphone signals. This is due to the presence of the FBF, which improves the target signal element in relation to interfering signals.

Adjustment

The calibration filters are adjusted by way of the nLMS algorithm (normalized least mean square algorithm) shown below.

$$C'_m(\omega,k+1)=C'_m(\omega,k)+\mu_{cal}F^*_m(\omega,k)E_m(\omega,k)P_{F_mF_m}(\omega,k),m=0,2, \tag{13}$$

where $\mu_{cal}$ is the step size parameter. $P_{FmFm}(\omega, k)$ is the estimated power for the frequency band around the frequency $\omega$:

$$P_{F_mF_m}(\omega,k)=\lambda_c P_{F_mF_m}(\omega,k-1)+(1-\lambda_c)|F_m(\omega,k)|^2 \tag{14}$$

with the forgetting factor $\lambda_c$. k denotes the block-time index.

Adjustment Control

The ABM filters attempt to mask out the signal components correlated between the FBF output and the sensor signals. For this reason and so that no spatially correlated interference is masked out, the ABM filters can only be adjusted when the desired signal is present. In other words ABM filters are adjusted in situations with a large signal to noise interval.

The same applies to the calibration algorithm. To prevent the calibration element in the microphones confusing the interference direction and the target signal direction, it too should only be adjusted in the event of a large signal to noise interval.

Figure 3:
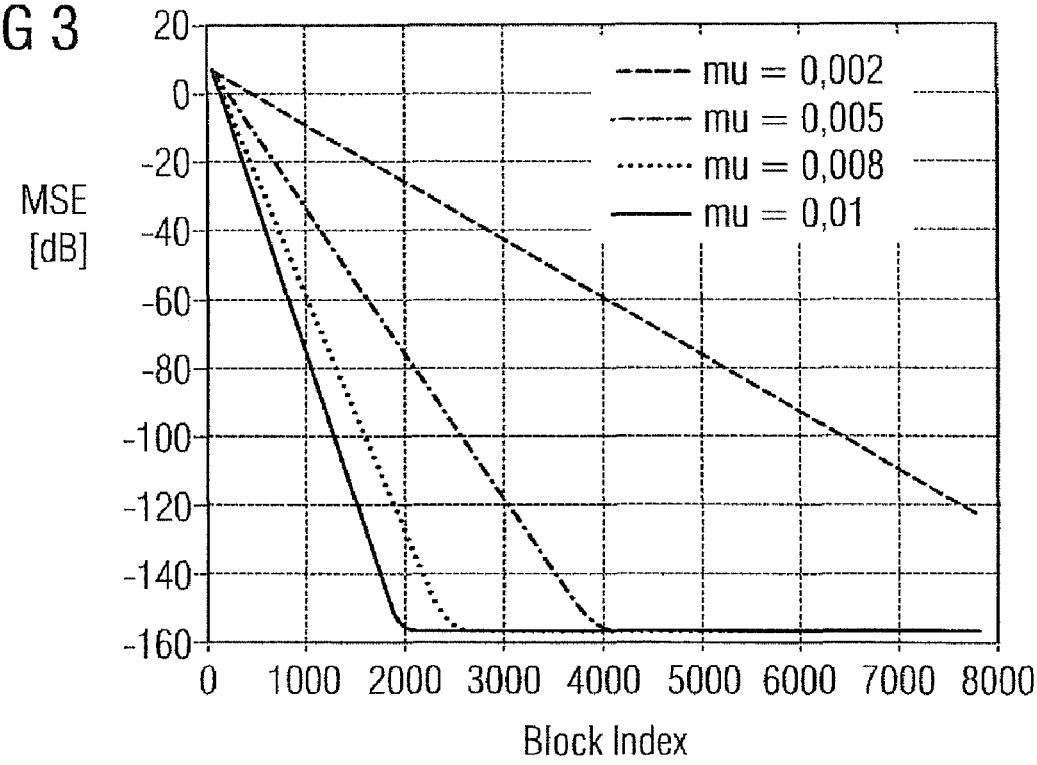
FIG. 3 shows an MSE plot of the calibration algorithm for the amplitude error of 1 dB and the phase error of −5° at the front microphone for different step size parameters $\mu_c$.
Figure 4:
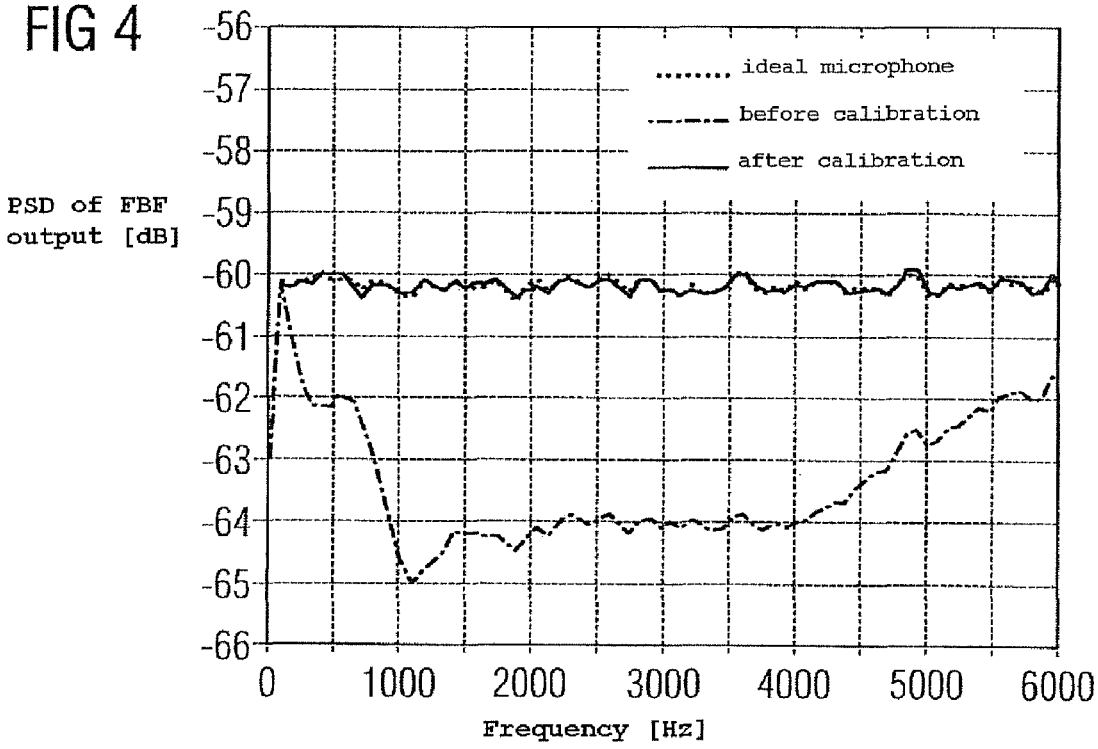
FIG. 4 shows the spectral power density of the FBF output for ideal microphones, poorly adjusted microphones (amplitude error of 1 dB and phase error of −5° at the front microphone) and subsequently adjusted microphones after calibration, $\mu_c$=0,008.

The results of a simulation are shown in FIGS. 3 and 4:

FIG. 3 shows an MSE plot of the calibration algorithm for the amplitude error of 1 dB and the phase error of −5° at the front microphone for different step size parameters $\mu_c$.

FIG. 4 shows the spectral power density of the FBF output for ideal microphones, poorly adjusted microphones (amplitude error of 1 dB and phase error of −5° at the front microphone) and subsequently adjusted microphones after calibration, $\mu_c$=0,008.

The invention claimed is:

1. An RGSC beamformer, comprising:

a plurality of microphones each generating a respective microphone signal;

a fixed beamformer connected to the microphones;

an adaptive blocking matrix connected to the fixed beamformer;

an adaptive interference canceller connected to the adaptive blocking matrix;

a calibration filter unit connected downstream from the microphones and comprising a calibration filter which compensates for a component tolerance of the microphones due to the effects of aging on the microphones; and a calibration filter calculation unit connected to the adaptive blocking matrix which calculates the calibration filter from a signal generated in the adaptive blocking matrix.

2. The RGSC beamformer as claimed in claim 1, wherein the fixed beamformer comprises a plurality of beamformer filters and an adding unit, wherein each of the beamformer filters is connected to one of the microphones for filtering the respective microphone signal, and wherein the adding unit adds the filtered microphone signals as an output signal of the fixed beamformer.

3. The RGSC beamformer as claimed in claim 2, wherein the adaptive blocking matrix comprises a plurality of adaptive blocking filters each for filtering the output signal of the fixed beamformer as a function of the respective microphone signal.

4. The RGSC beamformer as claimed in claim 3, wherein output signals of the adaptive blocking filters are fed as, input signals to the calibration filter calculation unit.

5. The RGSC beamformer as claimed in claim 4, wherein one of the output signals of the adaptive blocking filter is fed to the calibration filter calculation unit directly as a reference signal, wherein another one of the output signals of the adaptive blocking filter is fed to the calibration filter calculation unit after filtering by an adaptive calibration filter, wherein the signal filtered by the adaptive calibration filter is subtracted from the reference signal.

6. A method for operating an RGSC beamformer, comprising:

generating a microphone signal from a microphone;

connecting a fixed beamformer to the microphone;

connecting an adaptive blocking matrix to the fixed beamformer;

connecting an adaptive interference canceller to the adaptive blocking matrix;

connecting a calibration filter unit comprising a calibration filter downstream from the microphone;

compensating for a component tolerance of the microphone by the calibration filter wherein the component tolerance is due to the effects of aging on the microphone;

calculating the calibration filter adaptively by a signal generated from the adaptive blocking matrix; and filtering the microphone signal by the calibration filter.

7. The method as claimed in claim 6, wherein an output signal of the adaptive blocking matrix is used as a reference signal when calculating the calibration filter.

8. The method as claimed in claim 7, wherein the calibration filter is calculated adaptively such that a second output signal of the adaptive blocking matrix is filtered by an adaptive calibration filter and is subtracted from the reference signal and the resulting output signal is minimized.

9. The method as claimed in claim 6, wherein the calibration filter is calculated in the time range.

10. The method as claimed in claim 6, wherein the calibration filter is calculated in the frequency range.

* * * * *